US008021209B1

(12) United States Patent
Adkins et al.

(10) Patent No.: US 8,021,209 B1
(45) Date of Patent: Sep. 20, 2011

(54) NOVELTY SPORTS EQUIPMENT WITH ADJUSTABLE IMPACT SURFACE

(76) Inventors: Mark Adkins, East Brunswick, NJ (US); Joseph Pizzo, Runnemede, NJ (US)

( * ) Notice: Subject to any disclaimer, the term of this patent is extended or adjusted under 35 U.S.C. 154(b) by 167 days.

(21) Appl. No.: 12/475,445

(22) Filed: May 29, 2009

Related U.S. Application Data

(60) Provisional application No. 61/057,764, filed on May 30, 2008.

(51) Int. Cl.
*A63H 33/30* (2006.01)
*A63H 33/00* (2006.01)

(52) U.S. Cl. ..... 446/473; 446/486

(58) Field of Classification Search ..... 446/473, 446/486–488, 490–491; 428/4, 5, 7, 9, 12; 482/4, 5, 7, 9, 12
See application file for complete search history.

(56) References Cited

U.S. PATENT DOCUMENTS 5,130,169 A * 7/1992 DeJaynes ..... 428/7
5,873,766 A * 2/1999 Burton ..... 446/421
6,042,903 A * 3/2000 Yedlin et al. ..... 428/7

* cited by examiner

*Primary Examiner* — Kien Nguyen
(74) *Attorney, Agent, or Firm* — LaMorte & Associates, P.C.

(57) ABSTRACT

A toy assembly that has an impact surface made from an array of taut strings. The hardness of the impact surface is a function of the tension present in the strings. The toy assembly has two plates that are spaced apart. The two plates are held apart by a post. One or more of the plates may be selectively adjustable in position along the post. A plurality of strings extends between the first plate and the second plate. Each of the strings is maintained in tension to create a resilient impact surface. The strings are maintained in tension by the use of spring clips and/or by adjusting the distance between the two plates.

15 Claims, 5 Drawing Sheets

NOVELTY SPORTS EQUIPMENT WITH ADJUSTABLE IMPACT SURFACE

RELATED APPLICATIONS

This application is a continuation-in-part of Provisional Patent Application No. 61/057,764, filed May 30, 2008, entitled Novelty Sports Equipment With Adjustable Impact Surface.

BACKGROUND OF THE INVENTION

1. Field of the Invention

In general, the present invention relates to novelty sports equipment, such as toy bats, toy golf clubs, and toy balls that have impact surfaces. More particularly, the present invention relates to the structure of such equipment and any feature that enables the hardness of the impact surface to be selectively adjusted.

2. Prior Art Description

Many sports require specialized equipment. For instance, the sport of golf requires the use of golf clubs. Baseball requires the use of baseball bats. In the toy industry, most every piece of sports equipment has been produced in a toy version for children who are too young to play the real sport. As such, there exist toy golf clubs, toy baseball bats and the like. The toy version of sports equipment is typically much smaller, lighter and softer than the true piece of sports equipment so as not to present a danger to the children who play with these items.

Although a toy golf club or a toy bat is smaller and lighter that its real counterpart, many such toys are still capable of striking a ball with significant force. Consequently, the size, weight, and materials used to create toy bats, clubs and balls are always a matter of compromise. If a bat, club and/or ball is made too well, the ball can be struck with enough force to cause injury or damage. Likewise, if a ball is able to travel too far when struck, the ball will not stay within the confines of a room or backyard during play. Conversely, if a toy bat, club or ball is made too light, small, or soft, the ball will only travel a short distance regardless of how hard the ball is struck. This adversely affects the play value of the toy.

It is well known in the field of sports equipment that an impact surface made of strings can be made more resilient than solid impact surface. This is why tennis rackets, handball rackets and the like have impact surfaces made of strings. Stings stretch when impacted and convert the energy of impact into spring energy. The spring energy is reapplied to the impacted ball, thereby providing more energy to the rebounding ball at it leaves the racket.

The present invention is a toy system that provides a string impact surface. However, the tension in the strings of the impact surface can be selectively adjusted to the needs of the children playing with the toy system. In this manner, a bat, club, or ball can be adjusted to have the resiliency characteristics appropriate for a specific circumstance. The details of the present invention toy system are described and claimed below.

SUMMARY OF THE INVENTION

The present invention is a toy assembly that has an impact surface made from an array of taut strings. The hardness of the impact surface is a function of the tension present in the strings. The toy assembly has two plates that are spaced apart. The two plates are held apart by a post. One or more of the plates may be selectively adjustable in position along the post.

A plurality of strings extend between the first plate and the second plate. Each of the strings is maintained in tension to create a resilient impact surface. The strings are maintained in tension by the use of spring clips and/or by adjusting the distance between the two plates.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention can be configured as most any ball striking implement or any ball for a ball striking implement, the present invention is particularly well suited as being configured as a bat, a golf club or a large ball, such as a football. Accordingly, the exemplary embodiments of the present invention selected for illustration show the invention configured as a bat, golf club and football in order to set forth the best modes contemplated for the invention. The illustrated embodiments, however, are merely exemplary and should not be considered a limitation when interpreting the scope of the appended claims.

Figure 1:
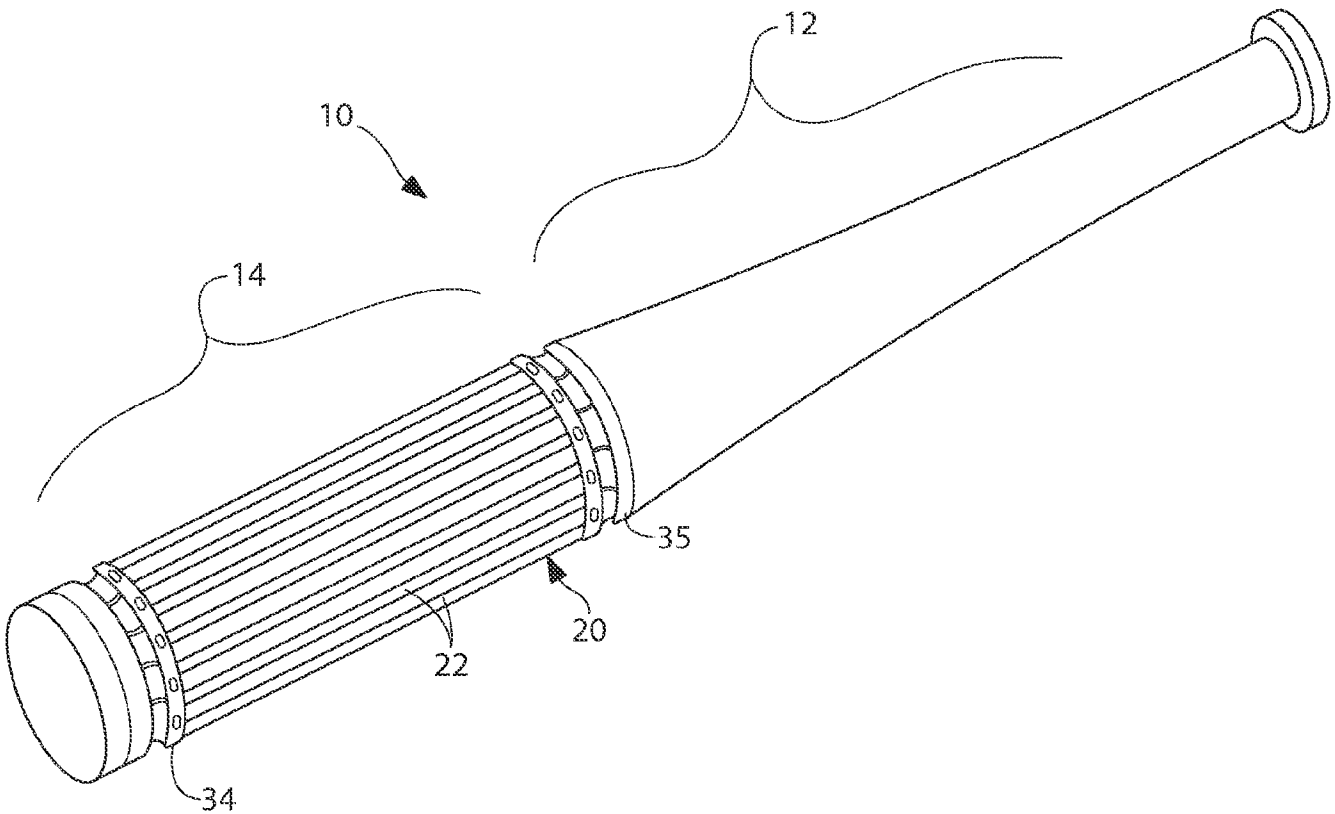
FIG. 1 is a perspective view of an exemplary embodiment of a bat in accordance with the present invention.
Figure 2:
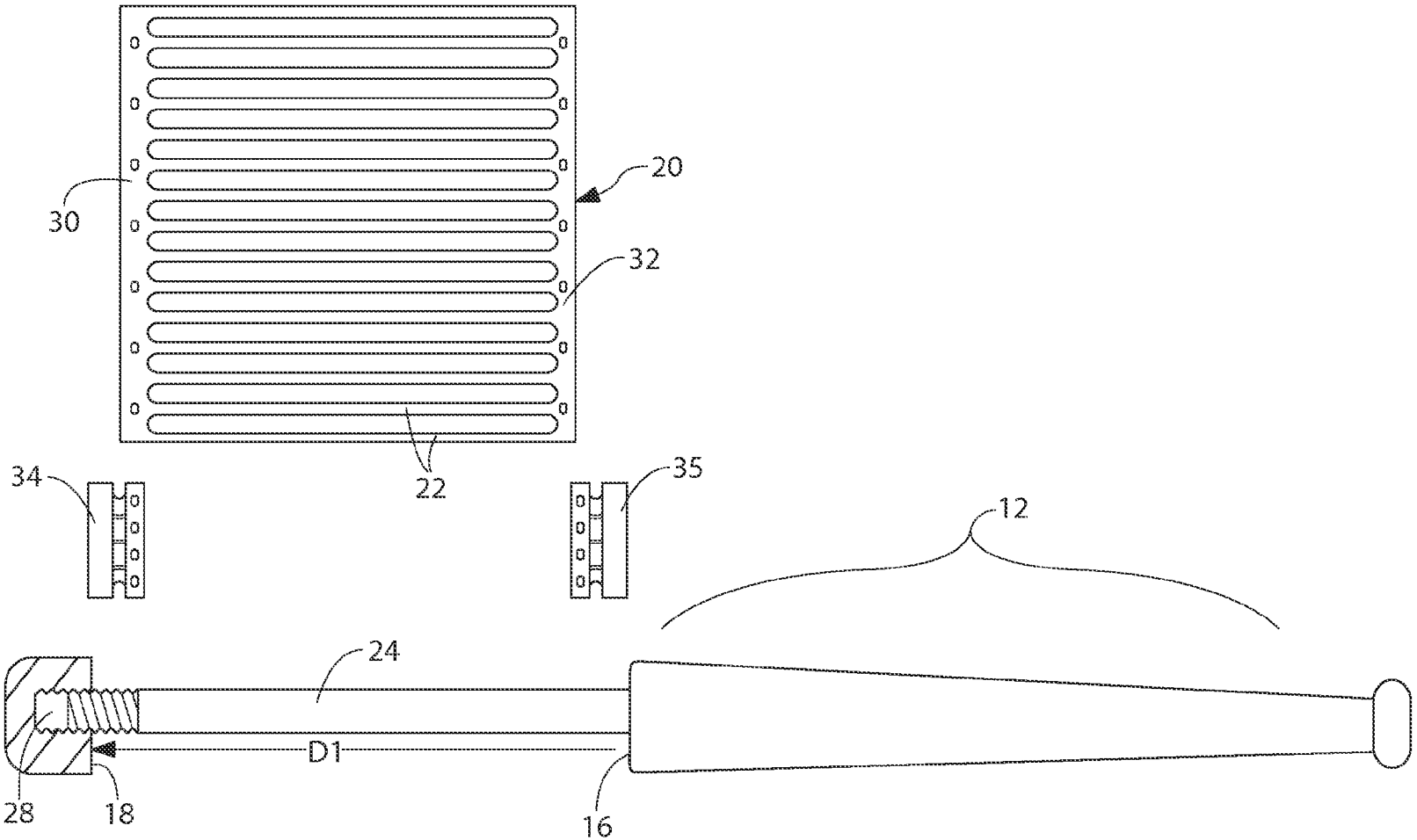
FIG. 2 is an exploded view of the exemplary embodiment of FIG. 1.

Referring to both FIG. 1 and FIG. 2, a novelty bat 10 is disclosed. The bat 10 has a handle section 12 and a striking section 14. The striking section 14 supports an array 20 of parallel support strings 22. The support strings 22 are pulled taut. The tighter the support strings 22 are pulled, the more resistant the support strings 22 are to bending and the "harder" the striking section 14 of the bat 10 becomes.

The striking section 14 of the bat 10 contains two plates 16, 18. The two plates 16, 18 are placed a predetermined distance D1 apart. A center post 24 extends through the center of the two plates 16, 18, interconnecting the two plates 16, 18. The two plates 16, 18 can be rigidly affixed to the center post 24. Alternatively, at least one of the two plates 16, 18 can be joined to the center post 24 with a threaded connection. In this manner, if a plate is turned relative to the center post 24, the threading of the plate will move along the center post 24 and the distance D1 between the two end plates 16, 18 will selectively change.

In the illustrated embodiment, the center post 24 is affixed to the handle section 12 of the bat 10. Accordingly, when the handle section 12 is rotated, the center post 24 also rotates. The first plate 16 is the front surface of the handle section 12 that faces the striking section 14. The center post 24 extends out of the first plate 16.

The second plate 18 is part of the end cap to the bat 10. The second plate 18 defines a threaded central bore 28. The top of the center post 24 is also threaded. Accordingly, the second plate 18 engages the center post 24 with a threaded interconnection. When the handle section 12 is rotated, the center post 24 rotates. If the second plate 18 is held still while the center post 24 rotates, the second plate 18 will move along the length of the center post 24 and the distance D1 between the first plate 16 and the second plate 18 can be selectively increased or decreased.

Strings can be individually strung between the first plate 16 and the second plate 18. However, it is preferred that an array 20 of strings 22 be provided. The array 20 of strings 22 is a unistructural plastic molding having a solid top band 30, a solid bottom band 32, and a plurality of parallel strings 22 that extend between the top band 30 and the bottom band 32. In the array 20, all the strings 22 are parallel. The top band 30 and the bottom band 32 run perpendicular to the strings 22.

Two rings of spring clips 34, 35 are provided. Each ring of spring clips 34, 35 is configured to engage one of the plates 16, 18 on the bat 10 and one of the solid bands 30, 32 of the array 20 of strings 22. Each ring of spring clips 34, 35 is flexible and resiliently resists being spread. Accordingly, when the ring of spring clips 34, 35 are used to attach the array 20 of strings 22 to the plates 16, 18, the rings of spring clips 34, 35 apply a constant tension to the array 20 that holds the strings 22 taut. In the shown embodiment, rings of spring clips 34, 35 are used to attach both the top and bottom of the array 20 of strings 22 to both the first and second plate 16, 18. It will be understood that only one ring of spring clips can be used only on one side of the array 20 of strings 22 if desired by a manufacturer.

Once the array 20 of strings 22 is affixed to the bat 10, the strings 22 define the periphery of the bat 10 in the striking section 14. The more taut the strings 22, the stiffer the striking section 14 becomes. As has been previously explained, the distance D1 between the first plate 16 and the second plate 18 can be varied by rotating the center post 24 and thereby moving the second plate 18 via its threaded connection with the center post 24. It will therefore be understood that the stiffness of the striking section 14 of the novelty bat 10 can be selectively adjusted by rotating the handle section 12 and increasing the distance D1 between the first plate 16 and the second plate 18. Conversely, the stiffness of the striking section 14 can be decreased by decreasing the distance D1 between the first plate 16 and the second plate 18. If the first and second end plates 16, 18 are configured not to be adjustable, the tautness of the array 20 of strings 22 is determined by the strength of the rings of spring clips 34, 35 being used to mount the array 20 in place.

Figure 3:
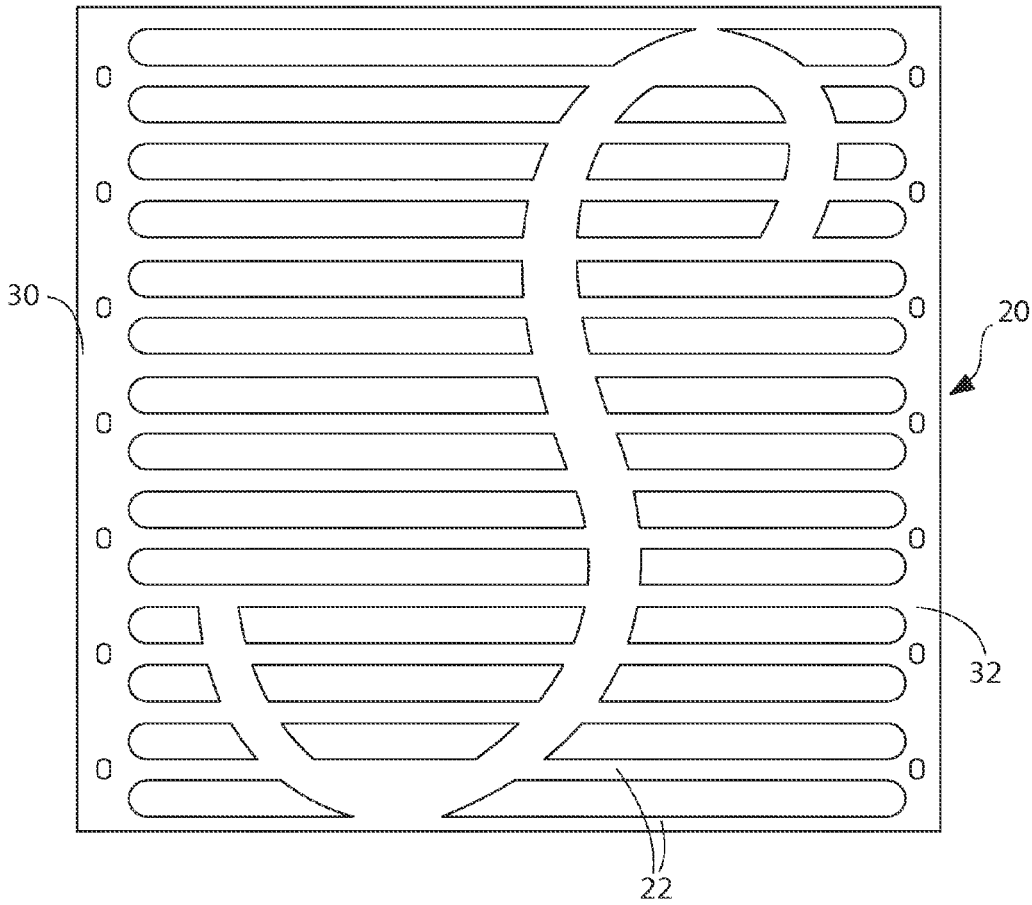
FIG. 3 is a front view of a variation of an array of strings used as the impact surface of the present invention.

Referring to FIG. 3, a modification for the array 20 of strings 22 is shown. In this embodiment, the strings 22 are arranged in parallel between top band 30 and a bottom band 32. To help prevent the strings 22 from spreading upon impact, a lateral element 25 is provided. The lateral element 25 can be attached to the strings 22. However, it is preferred that the lateral element be molded as part of the unistructural array 20. The lateral element extends across a plurality of the strings 22 at points between the top band 30 and the bottom band 32. The lateral element 25 can be formed as a decorative shape or as a name logo to add to the aesthetic appeal of the toy. The presence of the lateral element reinforces the strings 22 and helps prevent spreading between the strings 22 upon impact with a ball or similar object.

Figure 4:
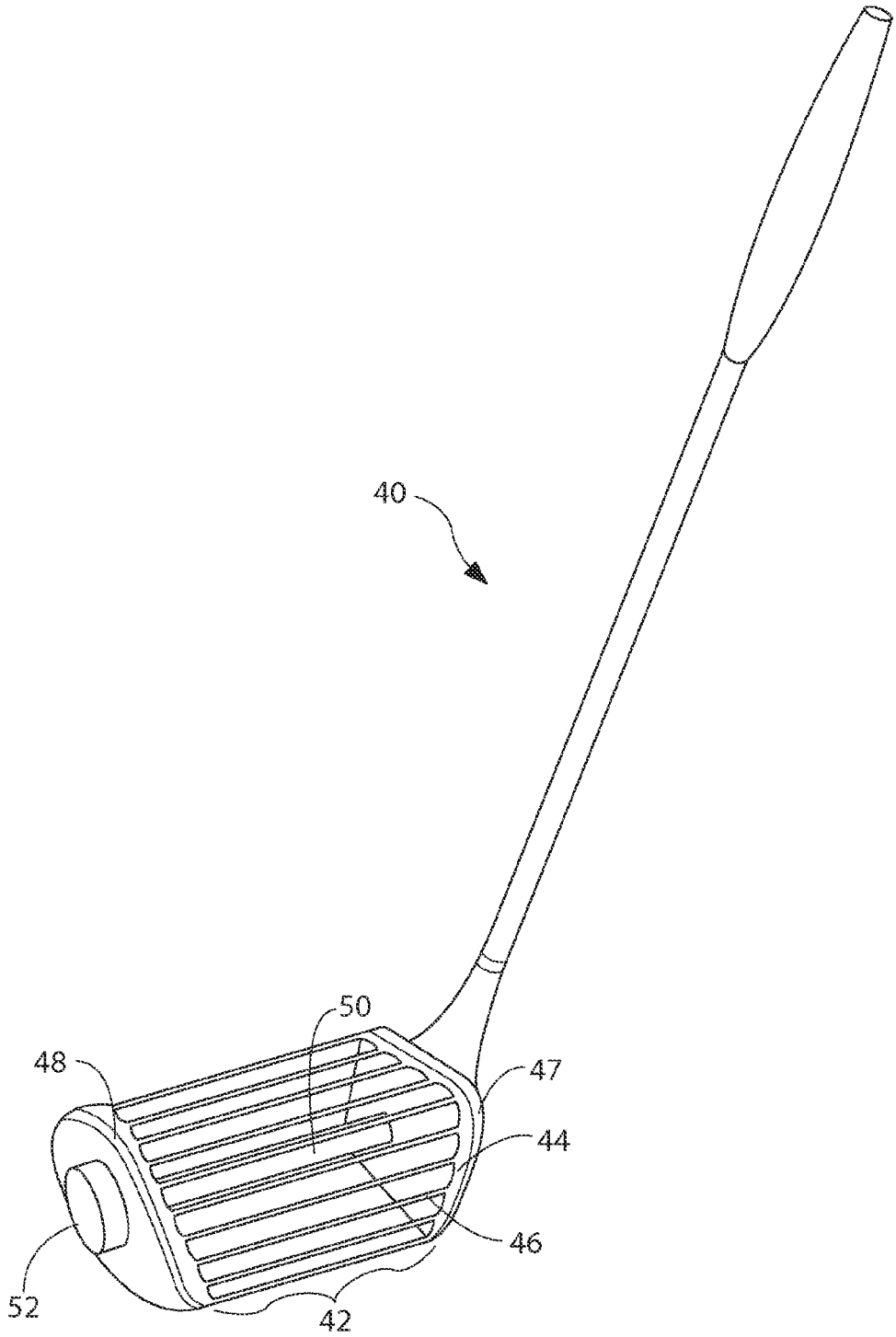
FIG. 4 is a perspective view of an exemplary embodiment of a golf club in accordance with the present invention.

Referring to FIG. 4, a novelty golf club head 40 is shown in accordance with the present invention. The golf club head 40 has a striking surface 42 made of an array 44 of strings 46. The array 44 of strings 46 preferably has the same unistructural molded construction as that of the first embodiment earlier described. The array 44 of strings 46 is mounted between a first plate 47 and a second plate 48. The two plates 47, 48 are held apart by a center post 50.

Like the earlier embodiment of the bat, the plates 47, 48 can be set in place or one of the plates 47, 48 can be adjustable relative to the center post 50. An optional adjustment knob 52 is shown. The knob 52 is attached to the center post 50 and rotates the center post 50 when turned. The second plate 48 engages the center post 50 with a threaded connection. Accordingly, when the knob 52 is turned, the center post 50 turns and the second plate 48 moves along the center post 50. This selectively changes the distance D2 between the first plate 47 and the second plate 48, therein making the strings 46 more or less taut.

In the embodiments of FIGS. 1-3, an array of strings is used to create the striking surface of a bat or club. The tension in the strings determines the stiffness of the strings and the overall resiliency of the striking surface. The bat or club can therefore be adjusted to a proper hardness for a given situation. For example a bat or club can be adjusted so that the bat or club would not be able to strike a ball out of a confined yard.

When a bat or club strikes a ball, two surfaces come into play. One is the striking surface of the bat or club. The other is the impacted surface of the ball being struck. It will be understood that the impact surface of a ball can be made from an array of strings in the same manner as a bat or club.

Figure 5:
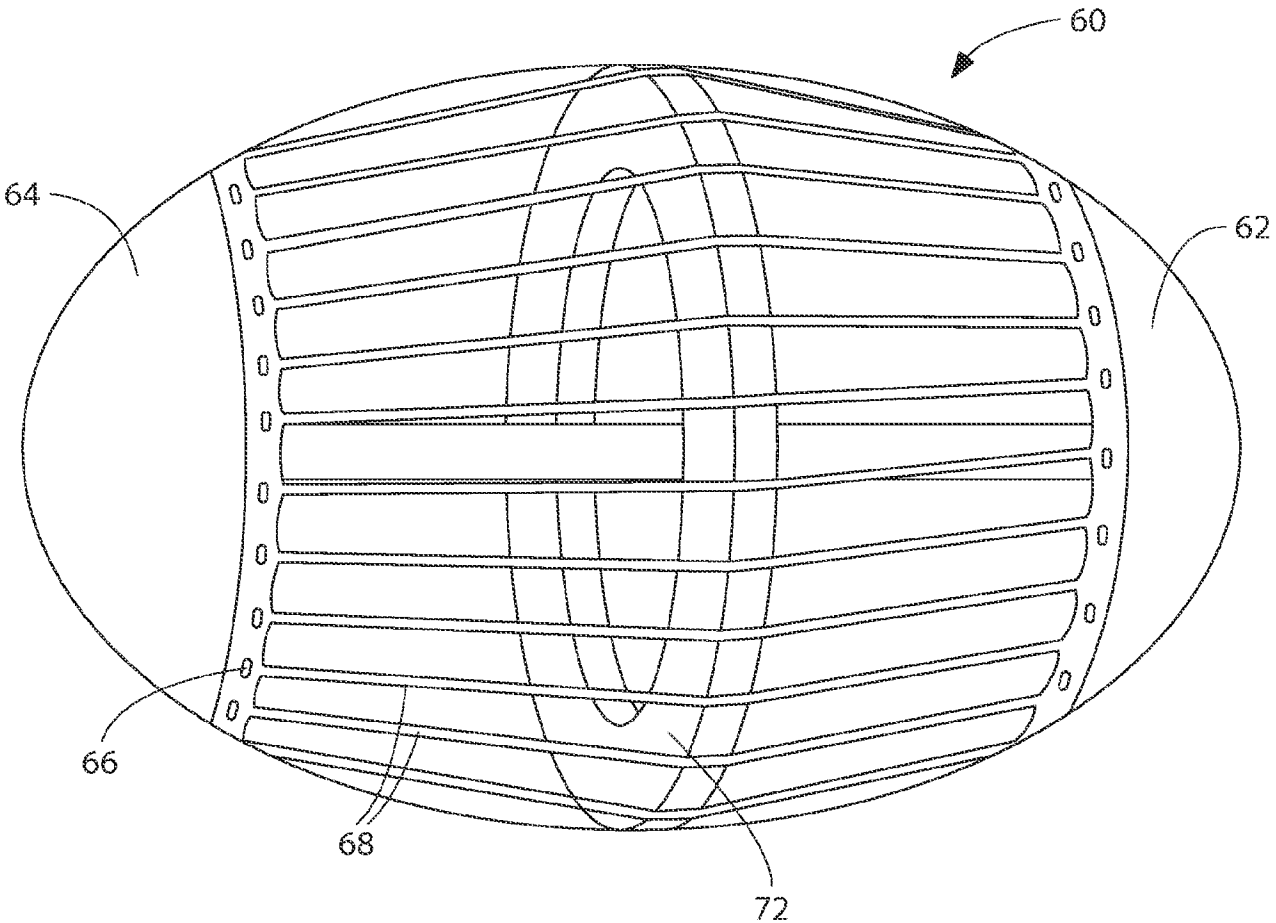
FIG. 5 is a perspective view of an exemplary embodiment of a football in accordance with the present invention.

Referring to FIG. 5, the present invention is configured as a ball. More specifically, the present invention is configured as an oblong football 60. The football 60 has two end plates 62, 64. An array 66 of strings 68 extends between the two end plates 62, 64. The two end plates 62, 64 are held a predetermined distance D3 apart by a center post 70 that extends between the two end plates 62, 64.

The football 60 has a maximum diameter at its center that is greater than that of the end plates 62, 64. A ring 72 is attached to the middle of the center post 70. The ring 72 has a diameter equal to the desired maximum diameter of the football 60. The array 66 of strings 68 stretches from the first end plate 62 to the second end plate 64 across the exterior of the ring 72. The strings 68 bend across the exterior of the ring 72, therein providing the football 60 with its overall oblong shape. Although the illustrated embodiment shows a single ring 72, it will be understood that a plurality of rings can be used between the two end plates 62, 64.

By creating a football 60 with an exterior that is derived from a plurality of strings 68, it will be understood that the football 60 is very easily gripped when caught. Furthermore, by making the string elements 68 very taut, the exterior of the football 68 becomes very resilient. This enables the football to be kicked long distances.

It will be understood that the embodiments of the present invention that are illustrated and described are merely exemplary and that a person skilled in the art can make many variations to those embodiments. For instance, other striking implements, such as cricket bats, can be made using the present invention. Likewise, other balls, such as soccer balls, can be made using the present invention. It should also be understood that the strings in all embodiments may be selectively covered in a flexible or elastic material if a toy manufacturer does not want the gap between parallel strings exposed. All such embodiments are intended to be included within the scope of the present invention as defined by the claims.

What is claimed is:

1. A toy assembly, comprising:

a first plate;

a second plate;

a post separating said first plate from said second plate; and a plurality of strings extending from said first plate to said second plate, wherein said plurality of strings extends in parallel between two bands that lay perpendicular to said strings, and wherein each of said plurality of strings is maintained in tension to create at least one resilient impact surface; and at least one lateral element that interconnects at least some of said strings at points between said two bands.

2. The toy assembly according to claim 1, wherein said bands and said plurality of strings are unistructurally molded from plastic as a single unit.

3. The toy assembly according to claim 1, further including a plurality of spring clips that interconnect said plurality of strings to said first plate and apply tension in said plurality of strings.

4. The toy assembly according to claim 1, further including a plurality of spring clips that interconnect said plurality of strings to said second plate and apply tension in said plurality of strings.

5. The toy assembly according to claim 1, wherein said second plate is affixed to said post with a threaded connection.

6. The toy assembly according to claim 1, wherein said first plate is affixed to said post with a threaded connection.

7. The toy assembly according to claim 6, further including a manually manipulative element coupled to said post for selectively turning said post.

8. A toy assembly having a striking surface for striking a ball, said assembly comprising:

a handle for holding said assembly;

a ball striking section having a first plate and a second plate and a plurality of strings that extend between said first plate and said second plate, wherein said strings create a resilient surface for impacting a ball; and a plurality of spring clips that interconnect said plurality of strings to said first plate and apply tension in said plurality of strings.

9. The toy assembly according to claim 8, further including a post that extends between said first plate and said second plate.

10. The toy assembly according to claim 9, wherein said handle is coupled to said post, whereby said post rotates when said handle rotates.

11. The toy assembly according to claim 8, wherein said second plate is affixed to said post with a threaded connection.

12. The toy assembly according to claim 8, wherein said plurality of strings extends in parallel between two bands that lay perpendicular to said strings.

13. The toy assembly according to claim 12, wherein said bands and said plurality of strings are unistructurally molded from plastic as a single unit.

14. The toy assembly according to claim 10, wherein said first plate, said second plate and said strings combine to form a ball shape.

15. A toy assembly, comprising:

a first plate;

a second plate;

a post separating said first plate from said second plate;

a plurality of strings extending from said first plate to said second plate, wherein each of said plurality of strings is maintained in tension to create at least one resilient impact surface; and a plurality of spring clips that interconnect said plurality of strings to said first plate and apply tension in said plurality of strings.

* * * * *